US011274893B1

(12) United States Patent
Kras et al.

(10) Patent No.: US 11,274,893 B1
(45) Date of Patent: Mar. 15, 2022

(54) TRIGGER WITH REDUNDANT STRIKER SAFETY

(71) Applicant: Sig Sauer, Inc., Newington, NH (US)

(72) Inventors: Krzysztof J. Kras, Fremont, NH (US); John Brasseur, Barrington, NH (US); Timothy Blazek, Barrington, NH (US); Adrian Thomele, Stratham, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 17/181,219

(22) Filed: Feb. 22, 2021

(51) Int. Cl.
*F41A 17/72* (2006.01)
*F41A 19/10* (2006.01)

(52) U.S. Cl.
CPC ..... *F41A 17/72* (2013.01); *F41A 19/10* (2013.01)

(58) Field of Classification Search
CPC ..... F41A 17/72; F41A 17/64; F41A 19/12; F41A 19/31
See application file for complete search history.

(56) References Cited

U.S. PATENT DOCUMENTS 3,985,060 A * 10/1976 Conley ..... F41A 9/33 89/34
9,194,639 B1 * 11/2015 Malheiros ..... F41A 17/60
2014/0196341 A1 * 7/2014 Tasyagan ..... F41A 17/48 42/69.01

* cited by examiner

*Primary Examiner* — J. Woodrow Eldred
(74) *Attorney, Agent, or Firm* — Finch & Maloney PLLC

(57) ABSTRACT

A trigger assembly is configured for a firearm having a striker movable along a bore axis between a cocked position and a fire position. The trigger assembly includes a trigger operable between a resting position and a pulled position. A first sear is operably coupled to the trigger and the striker. When the striker is in the cocked position, the first sear is movable from an engaged position to a disengaged position in response to moving the trigger from the resting position to the pulled position. A second sear is movable from a blocking position to a non-blocking position in response to moving the trigger from the resting position to the pulled position. When the trigger is in the resting position, the second sear is positioned to halt forward motion of the striker from the cocked position to the fire position.

16 Claims, 10 Drawing Sheets

TRIGGER WITH REDUNDANT STRIKER SAFETY

TECHNICAL FIELD

The present disclosure relates generally to a fire control assembly of a firearm. More specifically, the present disclosure relates to safety mechanisms of a trigger assembly.

BACKGROUND

Rifles, handguns, shotguns and other firearms have a fire control unit that can be housed in a receiver or frame. The fire control unit includes components that enable the firearm to fire when the trigger is pulled. Whether configured for a long gun or a handgun, components common to many such fire control units include a trigger, a sear, and a hammer or striker, where the sear is configured to retain the hammer or striker in a cocked position until the trigger is pulled. Upon pulling the trigger, the sear disengages from the hammer or striker, allowing it to move forward to strike the ammunition primer.

SUMMARY

In accordance with some embodiments, the present disclosure relates to a trigger assembly with a redundant striker safety and to a firearm including the trigger assembly. In one example, the trigger assembly includes a second sear that is positioned to halt forward movement of the striker after disengagement from the first sear, such as in the event of a malfunction. Principles of a trigger assembly in accordance with the present disclosure can be applied to fire control units of long guns and handguns alike. In one example, the trigger assembly is configured for a bolt-action rifle.

In accordance with some embodiments, the present disclosure also relates to trigger assembly with an adjustable trigger weight and a firearm including the trigger assembly. In one such example, a trigger weight lever biases the trigger towards the resting position. A spring has one end connected to an arm of the trigger weight lever and the other end connected to a spring catch with an adjustable position. By turning a fastener, for example, the position of the spring catch can be changed to adjust the spring tension, and in turn adjust the biasing force on the trigger.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1A:
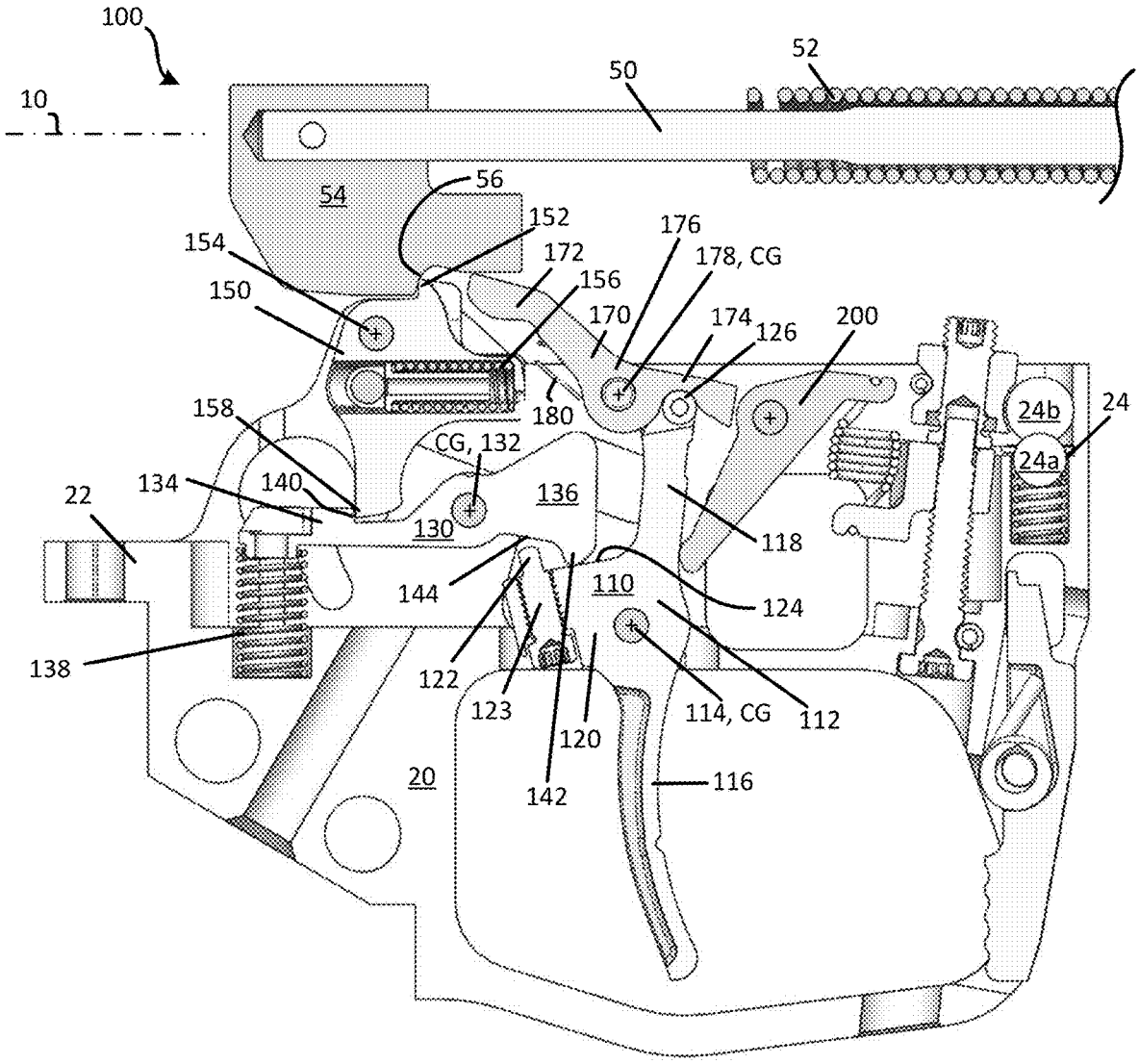
FIGS. 1A and 1B are side views showing a trigger assembly with the trigger at rest and the sear in a cocked position, in accordance with some embodiments of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a trigger assembly for a firearm having a striker that moves linearly along a bore axis between a cocked position and a fire position. In accordance with one embodiment, the trigger assembly includes a trigger operable between a resting position and a pulled position. A first sear is operably coupled to the trigger and the striker. When the striker is in the cocked position, the first sear is movable from an engaged position to a disengaged position in response to moving the trigger from the resting position to the pulled position. A second sear is positioned forward of the first sear. The second sear is operably coupled to the trigger and moves from a blocking position to a non-blocking position in response to moving the trigger from the resting position to the pulled position. When the trigger is in the resting position, the second sear has a blocking portion that is positioned to halt forward motion of the striker from the cocked position to the fire position.

In one example, pulling the trigger to the pulled position disengages the first sear from the striker body and moves the second sear to a non-blocking position with respect to the striker body. This condition normally results in firing the firearm by releasing the striker forward to strike the ammunition primer. However, in the event of a hung striker in which the striker fails to move forward after the trigger is fully pulled, and the trigger has returned at least part way to the resting position, the second sear is in a blocking positioned to engage the striker body (or other portion of the striker assembly). Thus, if the hung striker condition is overcome and the striker travels forward, the second sear is positioned to halt forward motion of the striker and prevent the striker contacting the ammunition primer.

General Overview

Existing fire control units for a bolt-action rifle include a trigger that, when pulled, disengages the sear from the striker and releases the striker forward to strike the ammunition primer. In the case of debris or dust in the trigger mechanism, an overly strong return spring on the sear, a weak striker spring, or a combination of these factors, the striker may fail to travel forward when disengaged from the sear. For example, after a firearm is subjected to high levels of fine dust, pulling the trigger may result in a failure to fire. In such condition, however, the striker remains ready to fire with the sear disengaged from the trigger bar. This condition is sometimes referred to as a hung striker or hang fire condition. In preparation for investigating the malfunction, the user may shake, set down, or drop the firearm, causing the striker to break free of the debris and fire the firearm unexpectedly.

As can be appreciated, a dangerous condition exists when a firearm does not fire upon pulling the trigger but still has the potential to fire unexpectedly. Thus, a need exists for a trigger assembly with an improved safety mechanism. The present disclosure addresses this need and others by providing a trigger assembly that includes a second sear.

Note that the trigger assembly is not limited to the particular orientations and geometries described below and shown in the Figures. For example, the same or similar function can be obtained by modifying the orientation of a given component, a component's center of gravity, the location of engagement surfaces, position or type of spring, or a combination of such changes, as will be appreciated. Variations in the arrangement and shape of components may also change depending on whether the trigger assembly is part of a removable trigger housing for a bolt-action rifle, a fixed assembly in a semiautomatic rifle, or trigger assembly in the receiver of a handgun, to name a few examples. Numerous variations and embodiments will be apparent in light of the present disclosure.

EXAMPLE EMBODIMENTS

Figure 1B:
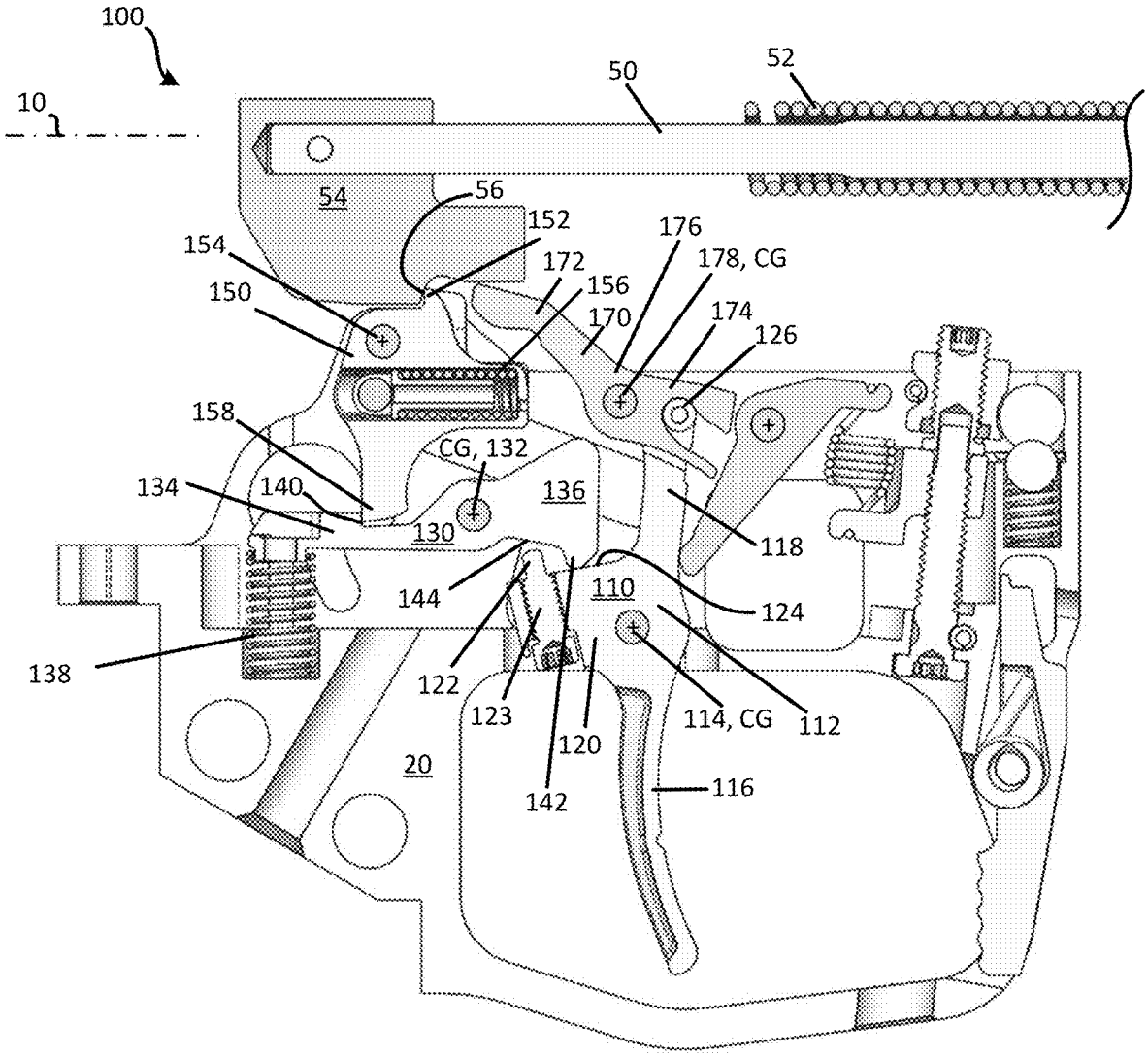

FIGS. 1A and 1B illustrate side views showing components of a trigger assembly 100 with the trigger 110 in a resting position and a striker 50 in a cocked condition, in accordance with some embodiments of the present disclosure. The firearm includes a striker 50 with a striker body 54 and striker spring 52. The striker 50 can move along a bore axis 10 between a cocked position (shown) and a fire position. Components of a trigger assembly 100 are retained in a trigger housing 20. In this example, the trigger housing 20 is configured for removable installation in a rifle stock, chassis, receiver, frame or equivalent. The trigger housing 20 includes a mounting lug 22 at its rear end with a through-bore for securing the trigger housing 20 to the firearm receiver (not shown). A retention latch 24 at the front of the trigger housing 20 is configured to engage or disengage from a corresponding catch on the firearm. In this example, the retention latch 24 includes a spring-loaded ball 24*a* and crosswise through-opening 24*b* to engage a detent pin or like structure in the firearm receiver. Other retention methodologies can be employed to removably retain the trigger housing 20 in a firearm stock or receiver, as will be appreciated.

Components of the trigger assembly 100 are housed in the trigger housing 20 and include a trigger 110, a trigger bar 130, a first sear 150, and a second sear 170. The trigger assembly 100 is operably coupled to the striker 50 where the striker 50 can be retained in the cocked position by the first sear 150 engaging the striker body 54. In other embodiments, the trigger assembly 100 is retained in a frame or receiver of the firearm, as appropriate.

In the cocked condition, pulling the trigger 110 from the resting position disengages the first sear 150 from the striker 50, allowing the striker spring 52 to drive the striker 50 forward to strike the ammunition primer and fire the firearm. The second sear 170 can prevent inadvertent discharge of the firearm in the event of a malfunction, such as a hung striker. When the trigger 110 is in the resting position (i.e., finger portion 116 is rotated forward), the second sear 170 occupies a blocking position with respect to the striker body 54. Thus, when the trigger returns partially or completely to the resting position after being pulled, the second sear 170 returns to a blocking position where it can engage the striker body 54 to halt forward movement of the striker 50 to the fire position. The trigger assemblies shown in FIGS. 1A and 1B differ in the configuration of the second sear 170, but otherwise are identical. Thus, with concurrent reference to FIGS. 1A and 1B, components of the trigger assembly 100 and their operation are discussed in more detail below.

The trigger 110 has a trigger body 112 defining a trigger axis of rotation 114. A finger portion 116 extends downward from the trigger body 112 and is configured to be engaged by the user's finger to rotate the trigger 110 about the axis of rotation 114 from a resting position to a pulled position. A first lever portion 118 extends upward from the trigger body 112. A second lever portion 120 extends generally rearward from the trigger body 112. The second lever portion 120 has a top surface 124 that contacts the trigger bar 130. The distal end of the first lever portion 118 includes a roller 126 or cam surface for engagement with the second sear 170. A trigger weight lever 200 or trigger spring acts on the first lever portion 118 to bias the trigger 110 to the resting position.

In this example, the first lever portion 118 is positioned generally opposite the trigger axis of rotation 114 from the finger portion 116, where the first lever portion 118 and finger portion 116 extend in opposite directions from the trigger body 112 (e.g., within a range of 150° to 200°, including 170° to 190°). The first lever portion 118 and the finger portion 116 are also positioned slightly forward of the axis of rotation 114. With this and other combinations of geometries, the trigger 110 can be configured to have a center of gravity CG that is coincident with or substantially coincident with (e.g., within ±1 mm) the trigger axis of rotation 114. As such, if the firearm is dropped, the mass of the trigger is unlikely to result in rotation of the trigger due to the impulse. In contrast, other triggers having a center of gravity CG spaced from the trigger axis of rotation 114 can generate rotational forces that may result in an unintentional trigger movement when the firearm is subjected to an impulse.

The trigger bar 130 contacts the trigger 110 during a trigger pull, causing the trigger bar 130 to rotate about its trigger bar axis of rotation 132. In one embodiment, the trigger bar 130 includes a first end portion 134 and a second end portion 136 that extend in opposite directions from the trigger bar axis of rotation 132. A trigger bar spring 138 biases the trigger bar towards a first or resting position where it is positioned to engage the first sear 150. In this example, the trigger bar 130 extends horizontally and the trigger bar spring 138 applies an upward force to the first end portion 134 so that the second end portion 136 is biased downward into contact with the second lever portion 120 of the trigger 110.

The first end portion 134 of the trigger bar 130 defines a catch surface 140 oriented and configured to engage a second catch 158 on the first sear 150 when the trigger bar 130 is in the first position. In one example, the catch surface 140 is a face extending transversely to (e.g., perpendicularly to or defining an acute angle with) the second end portion 136 of the trigger bar 130, and the second catch 158 is oriented to engage the catch surface 140, such as being parallel to the catch surface 140 (e.g., a substantially vertical surface (e.g., ±5°)). In this example, the catch surface 140 is an arc concentric with trigger bar axis of rotation 132.

The second end portion 136 of the trigger bar 130 optionally has a trapezoidal shape extending laterally from the trigger bar axis of rotation 132. Such shape is useful to balance the trigger bar 130 so that the center of gravity CG is coincident with the axis of rotation 132. Regardless of the actual shape, the first and second end portions are preferably sized and shaped so that the trigger bar axis of rotation 132 is coincident with or substantially coincident with the center of gravity CG (e.g., within 2 mm or within 1 mm). As discussed above for the trigger 110, the trigger bar's 130 center of gravity CG being coincident with the trigger bar axis of rotation 132 can reduce or eliminate inadvertent disengagement of the trigger bar 130 from the first sear 150 in the event of an impulse.

The lower part of the second end portion 136 defines a trigger bar protrusion 142 adjacent and forward of a recessed region 144, where the trigger bar protrusion 142 is oriented and sized to engage the top surface 124 of the second lever portion 120 on the rear of the trigger 110. The recessed region 144 is oriented and positioned to engage the protrusion 122 on the trigger 110 during the second stage of trigger pull. In this example, the recessed region 144 is positioned along the bottom edge of the second end portion 136 between the trigger bar protrusion 142 and the trigger bar axis of rotation 132.

In some embodiments, the trigger 110 is configured as a two-stage trigger having a longer first stage with a lower weight (i.e., a lower pull force) and a shorter second stage with a greater weight. In the first stage of trigger pull, the trigger bar protrusion 142 engages the top surface 124 of the trigger's second lever portion 120. In the second stage of trigger pull, the recessed region 144 on the trigger bar 130 contacts the protrusion 122 of the trigger 110. As illustrated, the trigger's protrusion 122 extends above the top surface 124 of the second lever portion 120 to provide a second engagement surface with the trigger bar 130. As the trigger 110 rotates through the first stage, the protrusion 122 comes into contact with the trigger bar 130 and is the point of contact to rotate the trigger bar 130 through the second stage of the trigger pull. During the second stage of trigger pull, the trigger bar protrusion 142 disengages from the top surface 124 of the second lever portion 120, in accordance with some embodiments.

In some embodiments, the protrusion 122 is an end of a trigger screw 123 or other threaded fastener or pin that extends through the second lever portion 120. The position of the trigger screw 123 can be adjusted to change the point of engagement with the trigger bar 130, as will be appreciated. In other embodiments, the protrusion 122 is a fixed surface, such as a bend, a point, a pin, a boss, a ridge, or some other structure on the top surface 124 of the second lever portion 120.

In other embodiments, the trigger 110 can be a single-stage trigger, where the recessed region 144 of the trigger bar and the protrusion 122 on the trigger are optional. In one such embodiment, the second lever portion 120 extends rearward from the trigger body 112 to engage the trigger bar 130. In yet other embodiments, the second lever portion 120 of the trigger 110 can directly engage the first sear 150, thus the trigger bar 130 can be eliminated. Numerous variations and embodiments will be apparent in light of the present disclosure.

The first sear 150 is positioned between the striker body 54 and the trigger bar 130. The first sear 150 is configured to rotate about a first sear axis of rotation 154 (e.g., a pin) between an engaged position (shown) and a disengaged position (e.g., shown in FIG. 4). A first sear spring 156 biases the first sear 150 towards the engaged position. For example, the first sear spring 156 is a compression spring retained within a cavity in the first sear 150 and exerts a force against a second pin to bias the first sear 150 towards the engaged position. The first sear spring 156 is selected so that the biasing force of the first sear spring 156 is overcome by the striker spring 52 when the first sear 150 disengages from the trigger bar 130 (or trigger 110), resulting in the first sear 150 rotating to the disengaged position. In other embodiments, the first sear spring 156 can be external to the first sear 150 and can be a different type of spring, such as a torsion spring or conical spring that engages the trigger housing 20 or some other structure.

As noted above, the first sear 150 defines a first catch 152 positioned and configured to engage the striker body 54 (or other portion of the striker 50) and retain the striker 50 in the cocked condition while the first sear 150 is in the engaged position. In this example, the first catch 152 is a rearward-facing vertical surface along the top of the first sear 150 when the first sear 150 is in the engaged position. The first catch 152 can engage the vertical or sloped forward-facing face 56 along the bottom of the striker body 54. The first sear 150 also defines a second catch 158 positioned and configured to engage the catch surface 140 on the trigger bar 130. In this example, the second catch 158 is a rearward-facing vertical surface adjacent the bottom of the first sear 150. In the cocked condition, the first sear 150 is retained in the engaged position due to the second catch 158 engaging the catch surface 140 on the trigger bar 130. Disengagement of the second catch 158 from the trigger bar 130 allows the first sear 150 to rotate to the disengaged position as urged to do so by forward movement of the striker body 54 along the bore axis 10 (in FIGS. 1A & 1B, forward movement is toward the right side of the page).

The trigger assembly 100 further includes a second sear 170 that is positioned and configured to engage the striker body 54 when the striker body 54 disengages from the first sear 150 and the trigger 110 is in the resting position. In this example, the second sear 170 is located forward of the first sear 150. The second sear 170 has a blocking portion 172 and a control portion 174, each of which extends away from a second sear body 176 that includes a second sear axis of rotation 178. The blocking portion 172 (or blocking arm) and control portion 174 (or control arm) each have an elongated shape that extends away from the second sear body 176 in different directions so as to define an angle of 120-180° between them, for example. A second sear spring 180 biases the second sear 170 to the blocking position. In some embodiments, such as shown in FIG. 1A, the second sear spring 180 is a double torsion spring having legs of the spring engaging the trigger housing 20, and a coil of the spring around a pin through the second sear body 176. Other suitable springs can be used, as will be appreciated.

In one embodiment, the blocking portion 172 extends upward and rearward from the second sear body 176 at an angle from 15-60° to the horizontal when the second sear 170 is in the blocking position, including an angle from 20-40°, or about 30°. Optionally, an end of the blocking portion 172 is positioned below and optionally contacts a bottom surface of the striker body 54 at a location that is forward of and vertically above the forward-facing face 56 of the striker body 54. As such, if the striker body 54 disengages from the first sear 150 and begins to move forward while the trigger 110 is in the resting position, the blocking portion 172 of the second sear 170 is positioned to engage the striker body 54 and halt its forward motion before the striker 50 impacts the ammunition primer.

In one embodiment, the control portion 174 extends forward, or forward and down, from the second sear body 176. As such, the control portion 174 is positioned to engage the roller 126 or trigger cam 128 on the distal end of the first lever portion 118 of the trigger 110 during rotation of the trigger 110. As the trigger 110 rotates from the resting position to the pulled position, the trigger 110 engages the control portion 174 of the second sear 170 and causes the second sear 170 to rotate to the non-blocking position (e.g., shown in FIG. 3).

Figure 2A:
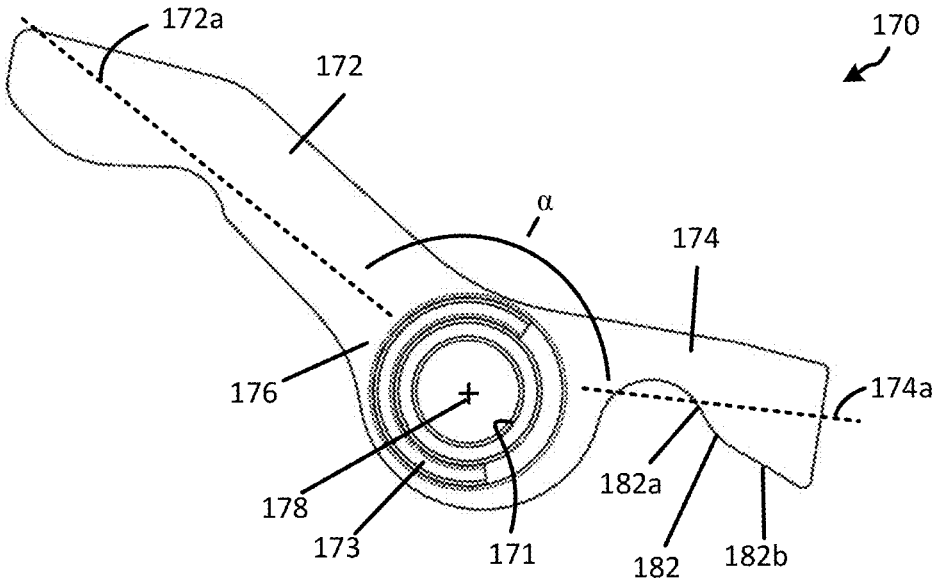
FIGS. 2A and 2B are side views of a second sear with an open cam configuration and a closed cam configuration, respectively, in accordance with some embodiments of the present disclosure.
Figure 2B:
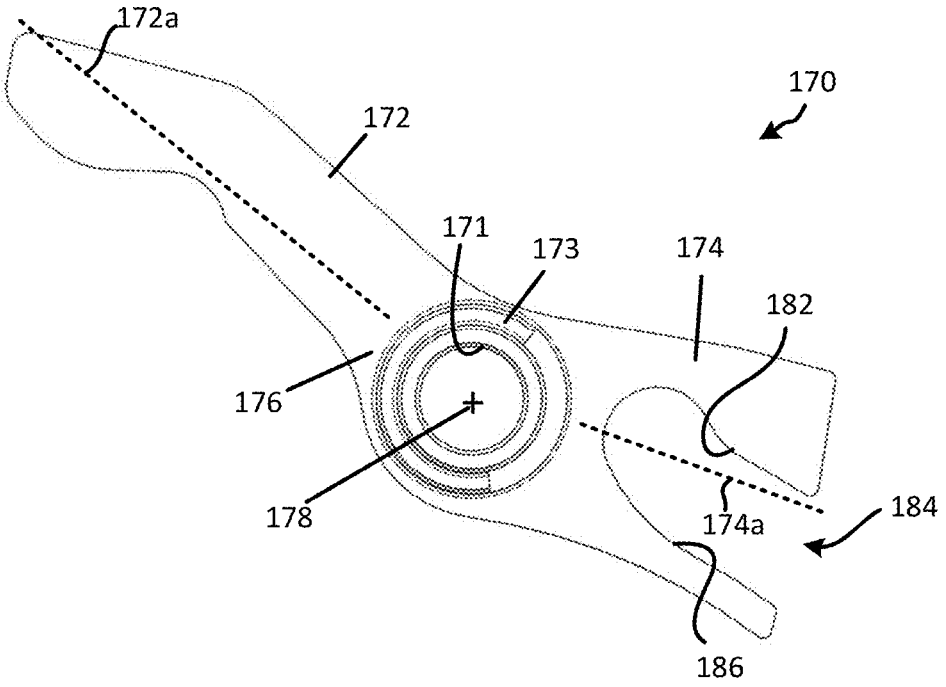

Referring now to FIGS. 2A and 2B, side views show the second sear 170, in accordance with some embodiments. In FIG. 2A, the second sear 170 has an open cam configuration, and in FIG. 2B the second sear 170 has a closed cam configuration. Features common to both embodiments include the second sear body 176 defining a second sear axis of rotation 178, the blocking portion 172 extending away from the second sear body 176 in a first direction 172*a* and the control portion 174 extending away from the second sear body 176 in a second direction 174*a* different from the first direction 172*a*. In some embodiments, the blocking portion 172 and the control portion 174 define an angle $\alpha$ of 90-180° between them, including an angle $\alpha$ of 120-180°, 150-165°, and 155-160°. A pin opening 171 is defined through a hub 173 that protrudes laterally from one or both sides of the second sear body 176. The hub 173 can accept the coil of the sear spring 180 (shown in FIG. 1A).

The control portion 174 has a cam surface 182 positioned to engage the roller 126 or trigger cam 128 during a trigger pull. In this example, the cam surface 182 is a downward facing surface oriented to contact the roller 126 along an actuate path as the first lever portion 118 rotates from the resting position to the pulled position or vice versa. In some embodiments, the cam surface 182 has a cam profile with more than one section to provide different rates of rotation of the second sear 170 along each section of the cam surface 182. For example, a first cam surface portion 182*a* has a first profile and a second cam surface portion 182*b* has a second profile different from the first profile. During the initial movement of the roller 126 along the first cam surface portion 182*a*, the second sear 170 rotates faster towards the non-blocking position, followed by a slower rotation (or no rotation) as the roller 126 moves along the second cam surface portion 182*b*.

For example, during the initial part of a trigger pull, the second sear 170 rotates to the non-blocking position in preparation for firing the firearm (counterclockwise in FIGS. 1A & 1B). As the trigger 110 continues to rotate to disengage the trigger bar 130 from the first sear 150, the second sear 170 continues to rotate at a slower rate or stops rotating. As the trigger 110 returns to the resting position after a trigger pull, the roller 126 can travel along the cam surface 182 in the reverse direction. During this movement, the second sear spring 180 biases the second sear 170 towards the blocking position so that the cam surface 182 maintains contact with the roller 126, therefore limiting the second sear 170 from returning to the blocking position until the trigger 110 returns at least part way to the resting position. In some instances, discussed in more detail below, the open configuration of the second sear 170 may result in the cam surface 182 disengaging from the roller 126, such as when the blocking portion 172 of the second sear is blocked by the bottom of the striker body 54 as the trigger 110 returns to the resting position.

In FIG. 2B the second sear 170 has a closed cam configuration, in accordance with an embodiment. In this example, the control portion 174 defines a slot 184 that includes the cam surface 182 in addition to a second cam surface 186 opposing and spaced from the cam surface 182. As shown in FIG. 1B, for example, the slot 184 is sized to contain the roller 126 during rotation of the trigger 110 between the resting position and the pulled position, where the roller 126 may contact the cam surface 182, the second cam surface 186, or both cam surfaces 182, 186 at different times during the roller 126 movement. The slot 184 prevents disengagement of the second sear 170 from the first lever portion 118 of the trigger 110 when the trigger 110 returns to the resting position. For example, if the second sear 170 is blocked by the striker body 54 from returning to the blocking position, the trigger 110 would only return part way to the resting position. This condition may occur after firing the firearm and prior to re-cocking the striker 50, where the striker body 54 remains in a forward position over the first sear 150 and second sear 170. Accordingly, when the second sear 170 is blocked from returning to the blocking position, the trigger 110 is also prevented from returning fully to the resting position. Cocking the firearm would reset the first sear 150 in the cocked condition and the second sear 170 in the blocking position. In this variant the use of the second sear spring 180 is not required.

Figure 3:
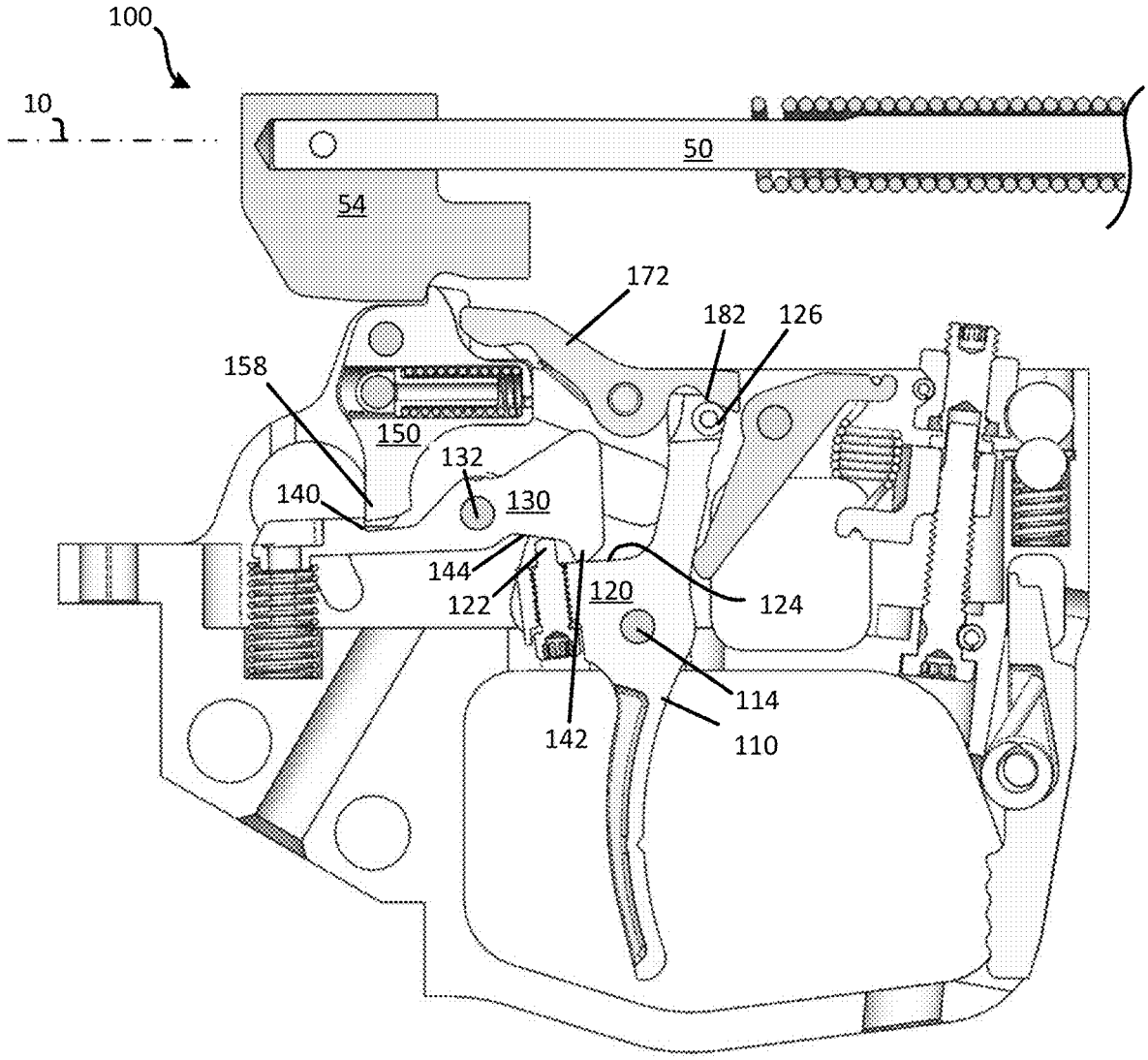
FIG. 3 is a side view of a trigger assembly showing the trigger at the end of the first stage of trigger pull, in accordance with an embodiment of the present disclosure.

Referring now to FIG. 3, a side view illustrates the trigger assembly 100 of FIG. 1A with the trigger 110 rotated part way to the pulled position, in accordance with an embodiment of the present disclosure. In this position, the trigger 110 has been rotated through the first stage of rotation and is at the "wall" at the beginning of the second stage of trigger pull. Note that the protrusion 122 on the trigger 110 contacts the recessed region 144 of the trigger bar 130 and the trigger bar protrusion 142 contacts the top surface 124 of the second lever portion 120. Note also that the trigger bar 130 has rotated so that the second catch 158 on the first sear 150 is close to disengaging from the catch surface 140 on the trigger bar 130.

As the trigger 110 continues to rotate to the pulled position, the lever arm of the trigger 110 (measured from the trigger axis of rotation 114) will increase as a result of contact with the trigger bar 130 shifting from a point along the top surface 124 to the protrusion 122. Additionally, the lever arm of the trigger bar 130 (measured from the trigger bar axis of rotation 132) will decrease as a result of the point of contact moving from the trigger bar protrusion 142 to a point along the recessed region 144. Both of these changes in lever arm distance cause an increase in the force necessary to further rotate the trigger 110, where this increased force is perceivable by the user during trigger pull and may be referred to as the "wall" at the start of the second stage of trigger pull leading up to the "break." In one example, the trigger weight in the first stage is between 0.8 and 2 lbs. such as from 1.0 to 1.5 lbs., or about 1.2 lbs. The trigger weight in the second stage is from 1.5 to 3.5 lbs., such as 2.5-3 lbs., or about 2.8 lbs. In the second stage of trigger travel, the trigger 110 need only rotate a small additional amount to disengage the first sear 150 from the catch surface 140 on the trigger bar 130 (the "break"), allowing the first sear 150 to rotate out of engagement with the striker body 54 and release the striker 50 forward.

Also note that at this stage of trigger travel, the roller 126 on the trigger 110 has traveled along the cam surface 182 on the second sear 170, rotating the second sear 170 to the non-blocking position where the blocking portion 172 out of the path of the striker body 54. In this position, the blocking portion 172 of the second sear 170 has rotated downward so that the striker body 54 is clear to move forward upon disengagement with the first sear 150. Additional trigger rotation towards the pulled position will cause the roller 126 to continue to travel along the cam surface 182, where the second sear 170 may or may not further rotate.

Figure 4:
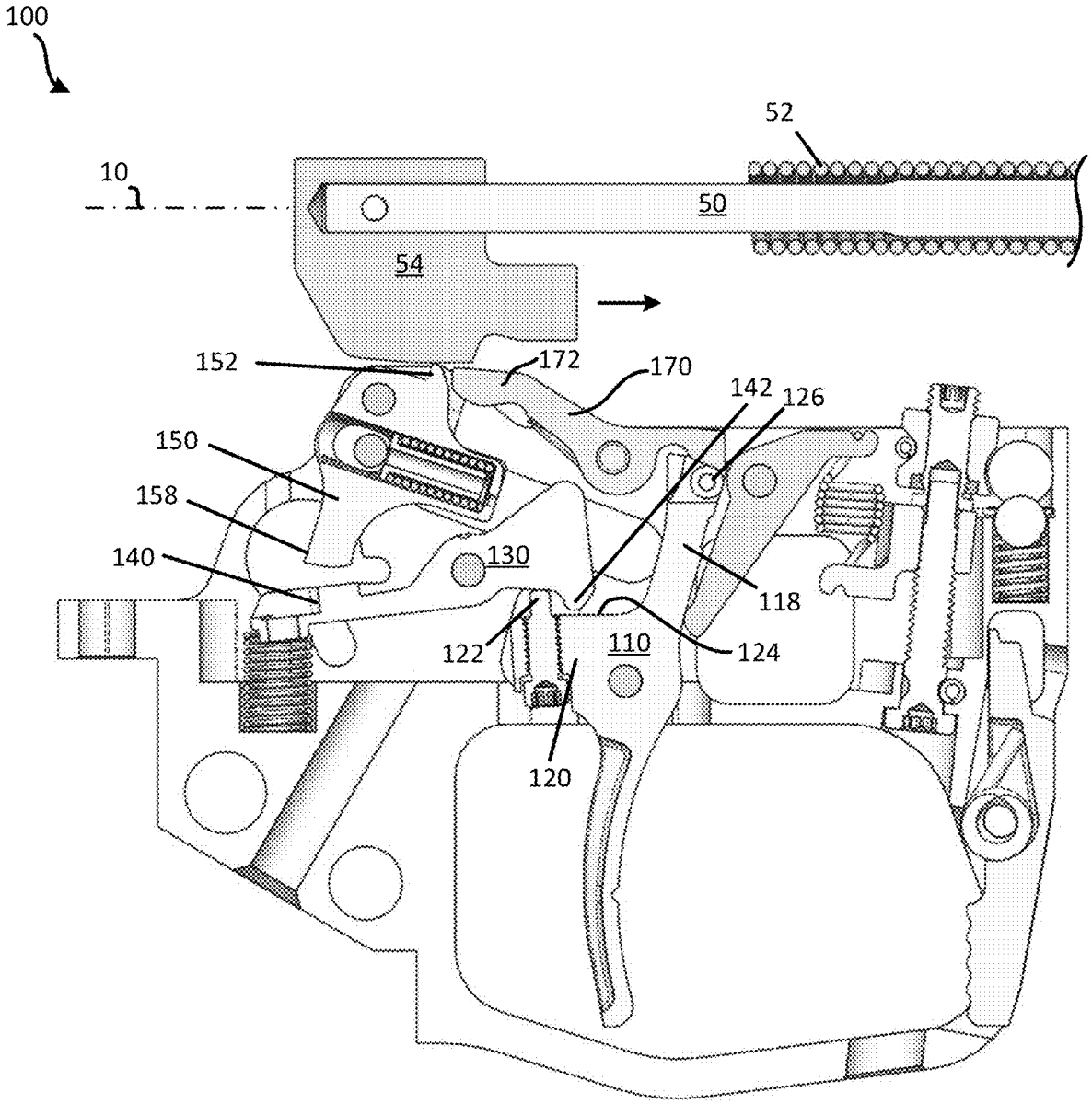
FIG. 4 is a side view of the trigger assembly of FIG. 3 with the trigger in a pulled position, in accordance with an embodiment of the present disclosure.

Referring now to FIG. 4, a side view shows the trigger assembly 100 of FIG. 1A with the trigger 110 rotated fully to the pulled position, in accordance with an embodiment of the present disclosure. Also, the roller 126 on the first lever portion 118 of the trigger 110 has further rotated the second sear 170 to the non-blocking position where the blocking portion 172 is vertically below and out of the forward path of the striker body 54. Having rotated the trigger to the pulled position, the trigger bar 130 has rotated to the second position and disengaged from the first sear 150. In more detail, the protrusion 122 on the trigger 110 is in contact with and has rotated the trigger bar 130 so that the second catch 158 on the first sear 150 has disengaged from the catch surface 140 on the trigger bar 130. Note that in the second stage of trigger pull that the trigger bar protrusion 142 does not contact the top surface 124 of the second lever portion 120 of the trigger 110. With the second catch 158 of the first sear 150 disengaged, the striker spring 52 has started to move the striker 50 forward along the bore axis 10. In doing so, the striker body 54 has overpowered the biasing force of the first sear spring 156 and rotated the first sear 150 to the disengaged position. So long as the striker body 54 remains in a forward position (e.g., a decocked position or the fire position), the first sear 150 is blocked from returning to the engaged position since the first catch 152 is positioned along the bottom of the striker body 54.

Figure 5A:
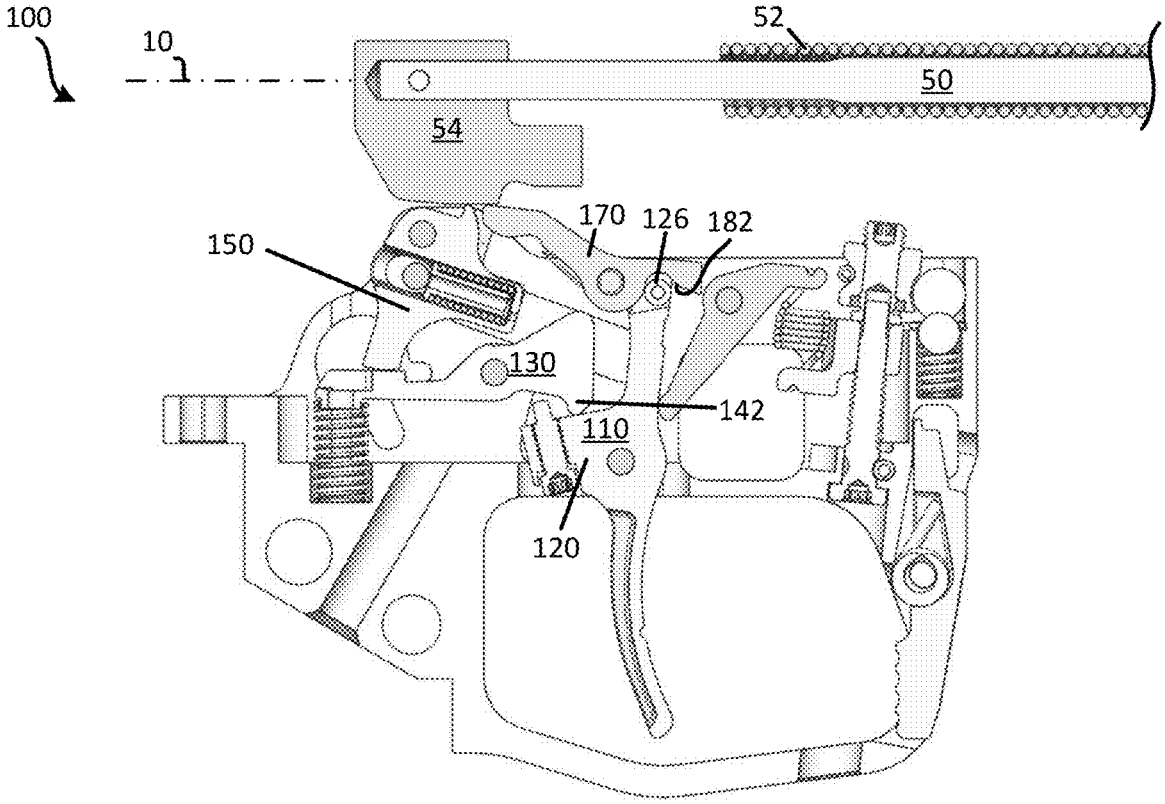
FIGS. 5A and 5B are side views of a trigger assembly showing the trigger returned fully or partially to the resting position after pulling the trigger, in accordance with an embodiment of the present disclosure.
Figure 5B:
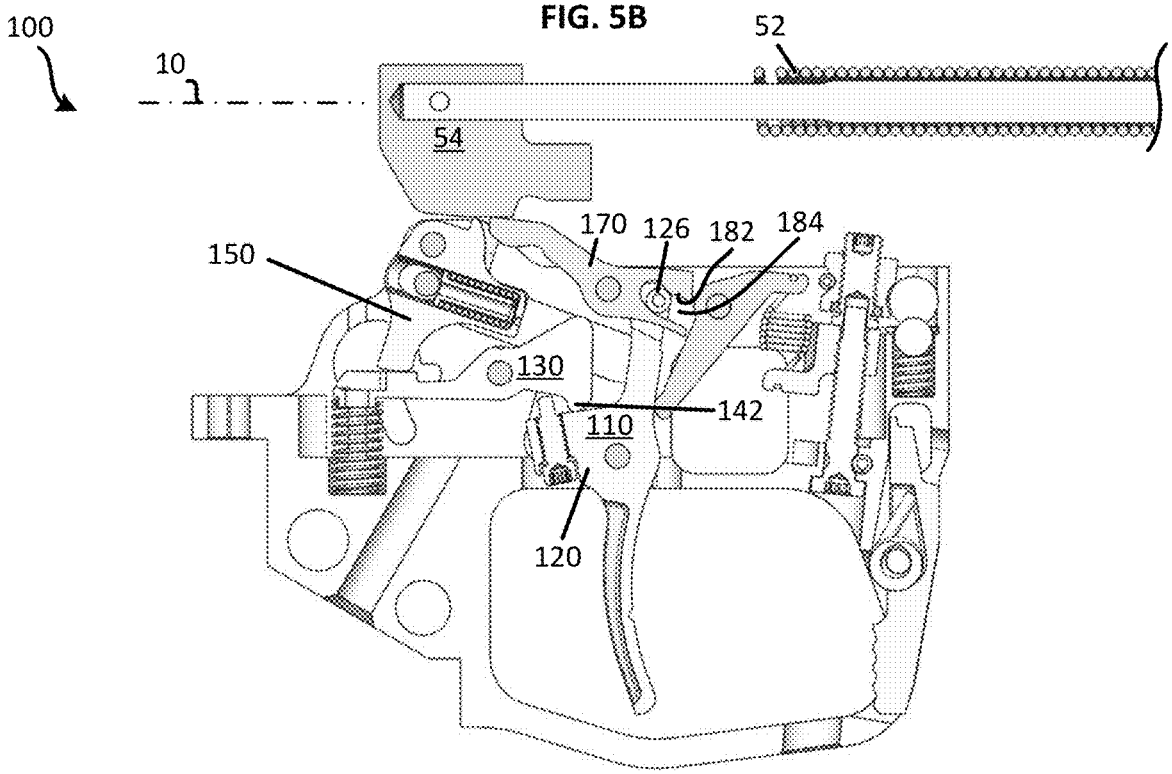

Referring now to FIGS. 5A and 5B, side views show the trigger assemblies 100 of FIGS. 1A and 1B, respectively, after pulling the trigger to fire the firearm, and then allowing the trigger to return partially or completely to the resting position, in accordance with some embodiments. In both of these figures, the striker 50 and striker body 54 remain in a forward position (e.g., a decocked position). Also, both the first sear 150 and the second sear 170 contact the bottom of the striker body 54 so that the first sear 150 is blocked from returning to the engaged position and the second sear 170 is blocked from returning to the blocking position. Further, the trigger bar 130 has returned to the first or resting position with the trigger bar protrusion 142 in contact with the top surface 124 of the trigger's second lever portion 120.

In FIG. 5A, the cam surface 182 on the second sear 170 has an open configuration.

The trigger 110 has rotated fully to the resting position, but the second sear 170 has not returned to the blocking position due to interference with the striker body 54. Since the cam surface 182 has an open configuration, the roller 126 has disengaged from the second sear 170 as the trigger 110 returned to the resting position but the second sear 170 has not returned to the blocking position. Cocking the action will return the striker 50 to the cocked position, allowing the second sear 170 to return to the blocking position with the cam surface 182 against the roller 126.

In FIG. 5B, the cam surface 182 on the second sear 170 has a closed-cam configuration where the roller 126 is captured in the slot 184. Thus, since the second sear 170 is blocked from returning to the blocking position, the trigger 110 is also prevented from returning fully to the resting position. Upon cocking the action, the striker 50 will move rearward and allow the second sear 170 to return to the blocking position. In doing so, the roller 126 will follow the slot 184 as the second sear 170 rotates and the trigger 110, allowing the trigger 110 to return to the resting position.

Figure 6A:
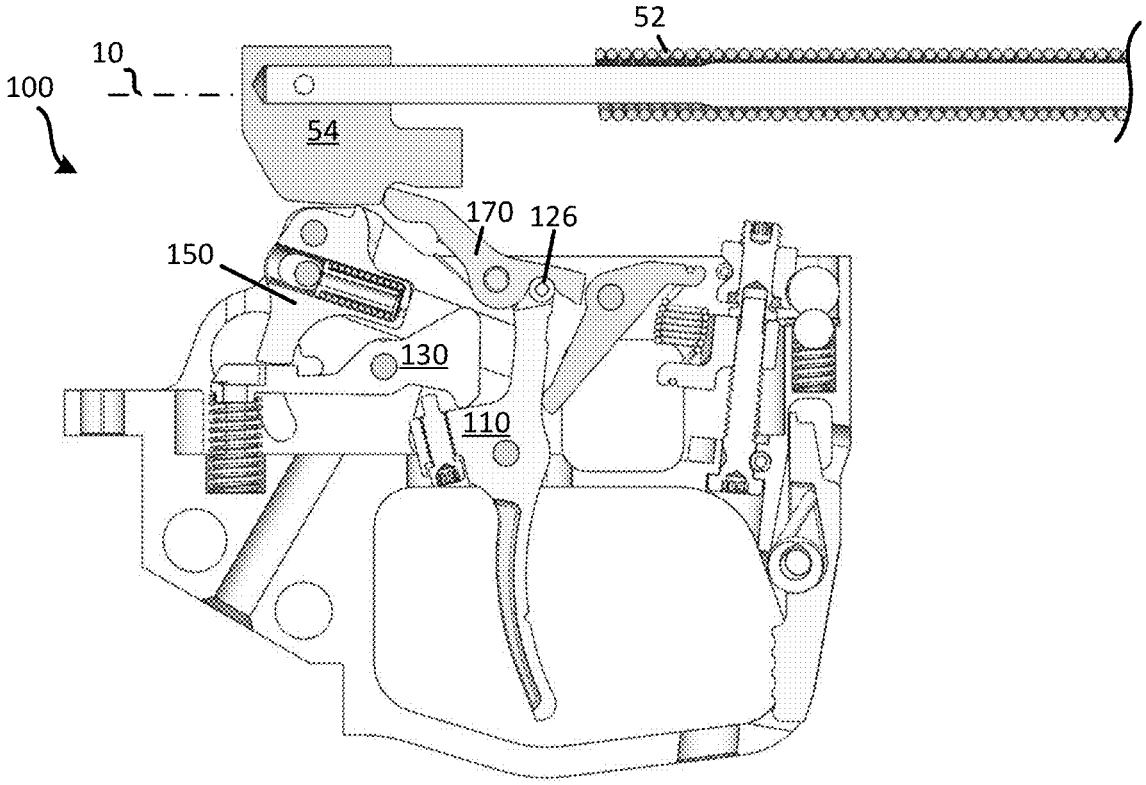
FIGS. 6A and 6B are side views of a trigger assembly showing the second sear engaged with the striker body, in accordance with an embodiment of the present disclosure.
Figure 6B:
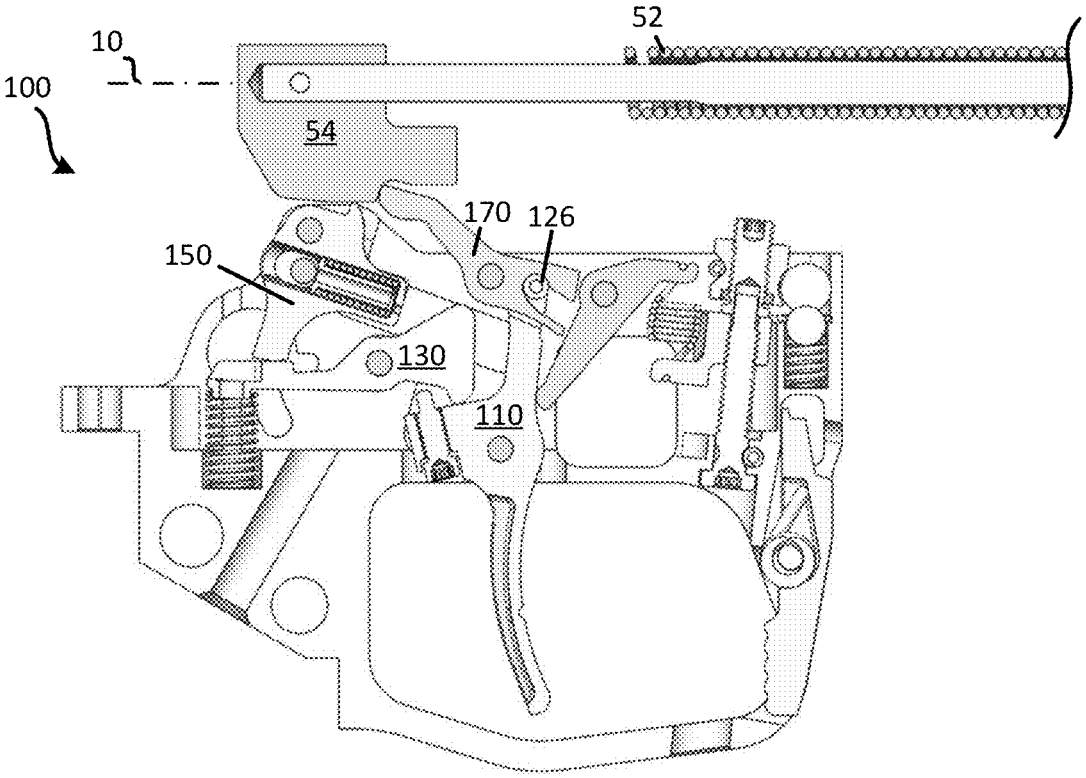

Referring now to FIGS. 6A and 6B, side views show the trigger assembly 100 of FIGS. 1A and 1B in a hung-striker condition, in accordance with some embodiments. For example, the striker 50 may be blocked from moving forward by dust or pine needles interfering with normal operation, or due to some other malfunction. In these examples, the trigger 110 was rotated to the pulled position, allowing the second catch 158 on the first sear 150 to disengage from the trigger bar 130. However, the striker 50 did not travel forward to the fire position as expected, and therefore results in a hung striker condition. After pulling the trigger 110, the trigger 110 was allowed to return to the resting position. Thus, if or when the striker 50 becomes unstuck and begins to move forward, the second sear 170 will engage the striker body 54 and block the striker 50 from contacting the ammunition primer, such as shown. While the second sear 170 is engaged with the striker body 54, the action is blocked from firing. The action can be reset by cocking and/or decocking the firearm, as will be appreciated.

Figure 7A:
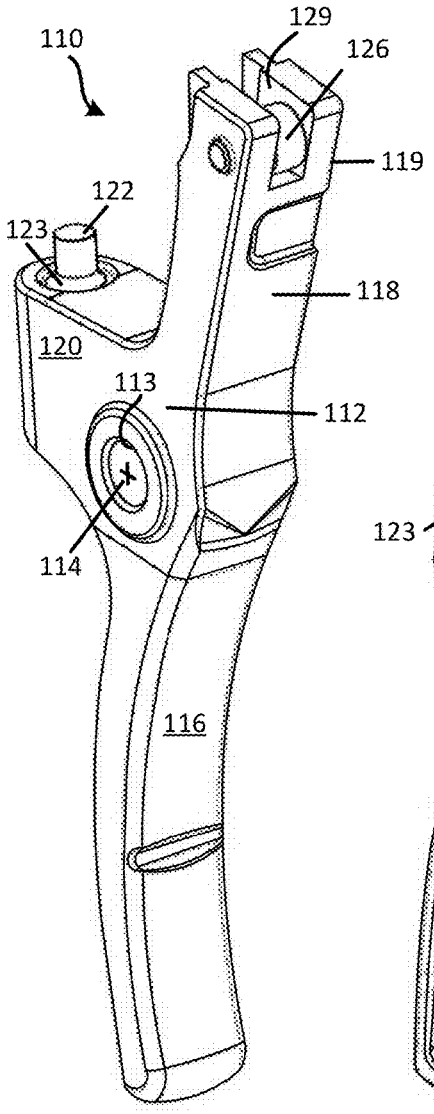
FIG. 7A is a front and side perspective view showing a trigger that includes a roller at the distal end portion of the first lever portion, in accordance with an embodiment of the present disclosure.
Figure 7B:
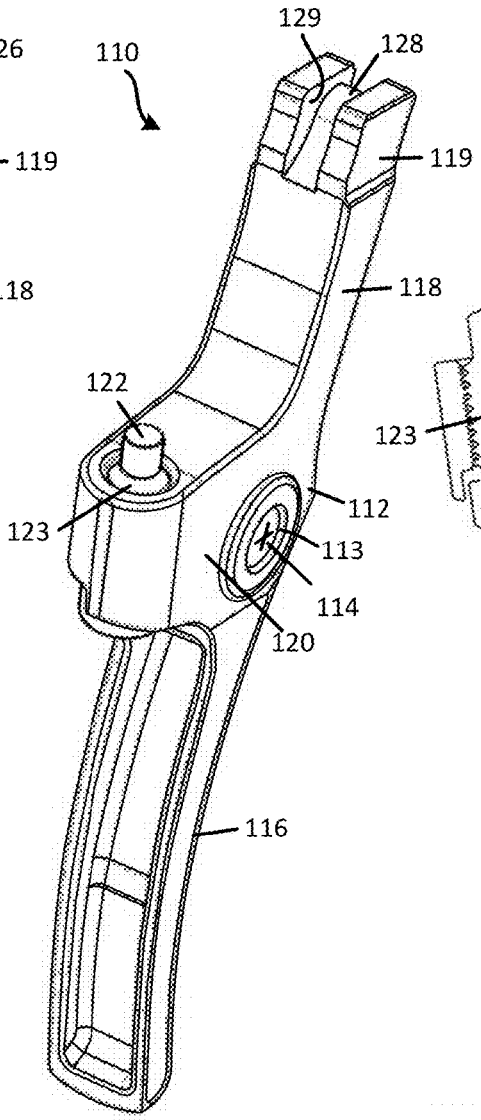
FIGS. 7B and 7C are rear perspective and side cross-sectional views, respectively, of a trigger with a trigger cam at the distal end of the first lever portion, in accordance with an embodiment of the present disclosure.
Figure 7C:
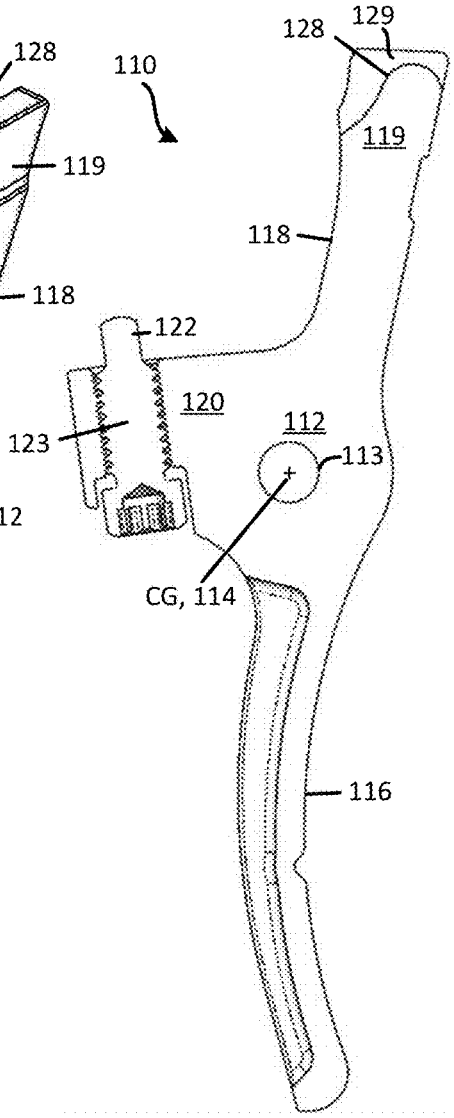

Referring to FIGS. 7A-7C, various views show examples of a trigger 110 that can be used with a trigger assembly 100 of the present disclosure, in accordance with some embodiments. FIG. 7A is a front and side perspective view showing a trigger 110 with a roller 126 on the distal end of the first lever portion 118. FIG. 7B illustrates a top and rear perspective view of a trigger 110 having a rounded trigger cam 128 on the distal end of the first lever portion 118. FIG. 7C illustrates a side cross-sectional view of the trigger 110 of FIG. 7B. In these examples, the trigger 110 is configured as a two-stage trigger with a protrusion 122 on the second lever portion 120. In other embodiments, the trigger 110 can be configured as a single-stage trigger 110.

Consistent with embodiments discussed above, each trigger 110 in these examples includes a trigger body 112 that includes a trigger pin opening 113 that defines the trigger axis of rotation 114. The finger portion 116 extends down from the trigger body 112 and a first lever portion 118 extends upward from the trigger body 112. A second lever portion 120 extends rearward from the trigger body 112. When the trigger 110 is configured for two-stage operation, as shown here, the second lever portion 120 includes a protrusion 122, such an end of a trigger screw 123. The center of gravity CG preferably is coincident with the axis of rotation 114, but this is not required.

In each of these examples, the roller 126 or trigger cam 128 is located in a channel or groove at the upper end of the distal end portion 119 of the first lever portion 118. Although optional, the channel 129 facilitates engagement between the roller 126 or trigger cam 128 with the cam surface 182 on the second sear 170. The channel 129 can also enhance lateral stability to help maintain engagement between the trigger 110 and the second sear 170, such as during an impulse that may tend to misalign components of the trigger assembly 100. In other embodiments, the channel 129 can be omitted and the distal end portion 119 of the first lever portion 118 primarily comprises the roller 126, or is rounded or otherwise shaped as needed for a trigger cam 128 to move along the cam surface 182 on the second sear 170.

Figure 8:
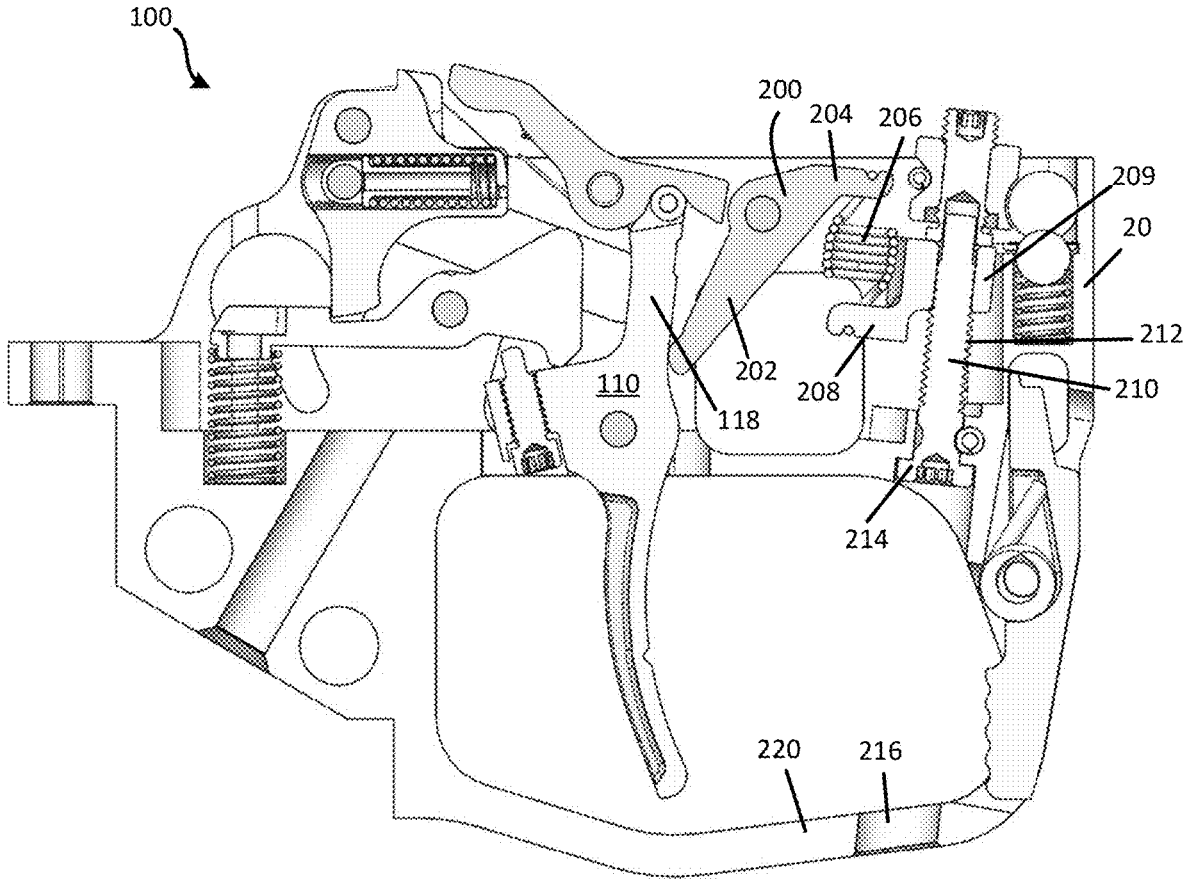
FIG. 8 is a side view of a trigger assembly that includes an adjustable trigger weight lever, in accordance with an embodiment of the present disclosure.

Referring now to FIG. 8, a side view illustrates a trigger assembly 100 with a trigger weight lever 200 that has an adjustable biasing force applied to the trigger 110. The trigger weight lever 200 is rotatable about a pin and has a first end portion 202 and a second end portion 204 extending in different directions. The first end portion 202 engages the trigger 110, applying a force to bias the trigger 110 towards the resting position. In this example, the first end portion 202 applies a force to the first lever portion 118 of the trigger 110. The second end portion 204 of the trigger weight lever 200 is connected to one end of a trigger weight spring 206. The opposite end of the trigger weight spring 206 is attached to a spring catch 208 that is movable by turning a threaded fastener 210 or rod. In one example, the fastener 210 functions as a screw drive to move the spring catch 208 towards or away from the second end portion 204 of the trigger weight lever 200. In this example, the spring catch 208 moves up or down by threaded engagement with the fastener.

In one embodiment, the fastener 210 has a fixed position in the trigger housing 20. The spring catch 208 has a body 209 that engages the threaded portion 212 of the fastener 210. As the fastener 210 is turned, the body 209 (and therefore the spring catch 208) moves along the fastener. When the spring catch 208 is drawn away from the second end portion 204 of the trigger weight lever 200, the spring tension is increased in the trigger weight spring 206, which results in a greater biasing force applied to the trigger 110 by the first end portion 202. On the other hand, when the spring catch 208 is moved closer to the second end portion 204, the spring force is reduced, resulting in a reduced force applied to the trigger 110.

In some embodiments, adjusting the spring tension on the trigger weight lever 200 results in a consistent change in trigger weight (pull force) in both the first stage and the second stage of trigger pull. That is, changing the trigger weight results in substantially the same increase or decrease (e.g., within ±0.1 pound of force (lbf)) in the force needed to rotate the trigger 110 in each of the first and second stages of trigger travel. For example, an increase in force of 0.5 lbf in the first stage of trigger travel also increases the force in the second stage of trigger travel by 0.5 lbf. Although the trigger weight lever 200 of FIG. 8 is shown with a two-stage trigger, the trigger weight lever 200 can alternately be used with a single-stage trigger.

As shown in the example of FIG. 8, the fastener 210 extends generally upright (e.g., vertical ±20°). In one example, the head 214 of the fastener 210 can be accessed through an opening 216 in the trigger guard 220. Thus, the trigger weight can be easily adjusted using a screwdriver or similar tool without disassembling the firearm. As will be appreciated, the trigger weight lever 200 can have different orientations and geometries than shown. Also, although a coil spring is shown for the trigger weight spring 206, other types of springs can be used. In one such embodiment, the trigger weight spring 206 is a torsion spring with a leg of the spring engaging the spring catch 208. In another embodiment, moving the spring catch 208 changes the amount of compression in a trigger weight spring 206 (e.g., a coil spring) located in compression between the spring catch 208 and the trigger weight lever 200.

Note that the trigger weight lever 200 is not required and can be replaced by a trigger spring acting on the trigger 110. In one such embodiment, a trigger spring extends between the trigger housing 20 and the first lever portion 118 of the trigger 110. In another embodiment, a torsion spring is installed around the trigger pin. Numerous variations and embodiments will be apparent in light of the present disclosure.

Figure 9:
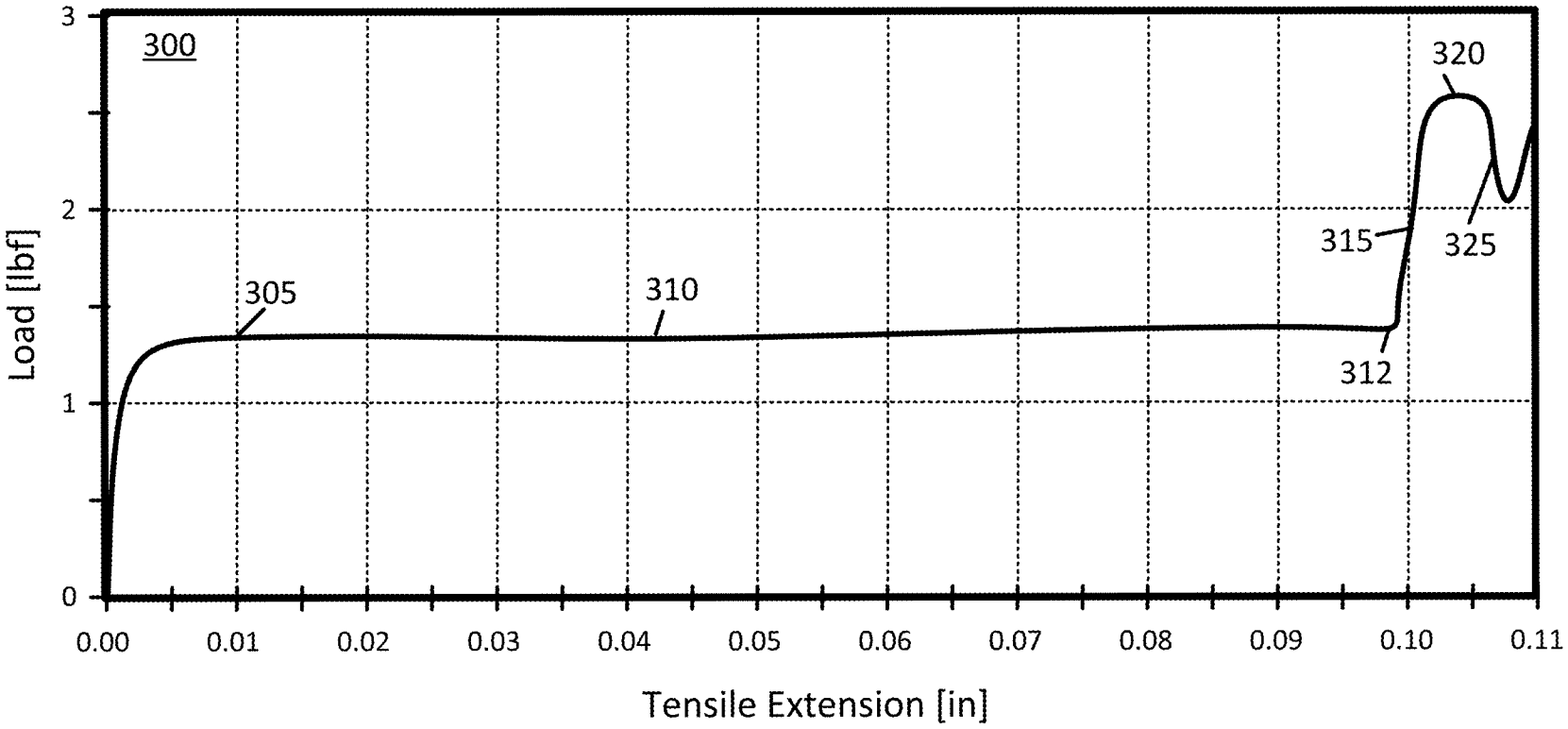
FIG. 9 is a plot of trigger load vs. tensile extension for a two-stage trigger, in accordance with an embodiment of the present disclosure.

FIG. 9 is a plot 300 of trigger pull force (pounds of force, lbf) vs. tensile extension or travel of the trigger 110 (inches), in accordance with some embodiments. Tensile extension is measured as the displacement of the finger portion 116 of the trigger 110 as measured from a vertical midpoint of the finger portion 116, for example. At the far-left portion of the plot 300, the pull force rises quickly to about 1.4 lbf as the trigger pull begins to a point of engagement 305 at about 0.01 inch of extension. The pull force includes a relatively flat pull force through the first stage 310 of trigger pull. In this example, the first stage 310 occurs from about 0.01 inch to about 0.095 inch of trigger movement, just before the stop point 312 for the first stage 310. In this example, the pull force increases about 0.033 lbf between the point of engagement 305 to the stop point 312 of the first stage 310 of trigger pull (an average slope of 0.52 lbf/in). In some embodiments, the average slope of the trigger pull from the point of engagement 305 to the stop point 312 of the first stage 310 (or substantial portion thereof, such as 75%, 80%, or 90%) is not greater than 1.0 lbf/in, including not greater than 0.8 lbf/in, not greater than 0.65 lbf/in, and not greater than 0.55 lbf/in. Transitioning to the second stage 320 of trigger pull is a steep incline in force or "wall" 315 at approximately 0.10 inch of tensile extension. The force at the second stage 320 is approximately 2.5 lbf. Note that the second stage 320 is relatively short, about 0.005 inch of tensile extension from the wall 315 to the "break" 325 when the striker 50 is released.

In some embodiments, the difference in pull force between the first stage 310 and the second stage 320 is consistent for various settings of the trigger force adjustment. In this example, the difference is about 1.1 lbf. The magnitude of this difference is set by the trigger bar spring 138. In other embodiments, the difference between pull force in the first stage 310 and the second stage 320 is from 0.8 to 2.0 lbf, including 1.0-1.3 lbf, 1.2-1.6 lbf, and 1.4 to 1.8 lbf. As discussed above, for example, increasing or decreasing the pull force raises or lowers the entire curve, where the difference between the pull forces in the first stage 310 and second stage 320 is constant within ±0.2 lbf or less.

Further Example Embodiments

The following examples pertain to further embodiments, from which numerous permutations and configurations will be apparent.

Example 1 is trigger assembly for a firearm having a striker movable along a bore axis between a cocked position and a fire position. The trigger assembly comprises a trigger operable between a resting position and a pulled position; a first sear operably coupled to the trigger and the striker, wherein when the striker is in the cocked position the first sear is movable from an engaged position to a disengaged position in response to moving the trigger from the resting position to the pulled position; and a second sear positioned forward of the first sear, the second sear operably coupled to the trigger and movable from a blocking position to a non-blocking position in response to moving the trigger from the resting position to the pulled position, wherein when the trigger is in the resting position the second sear has a blocking portion positioned to halt forward motion of the striker from the cocked position to the fire position.

Example 2 includes the subject matter of Example 1, wherein the second sear includes a control arm, the control arm engaging a part of the trigger when the trigger moves from the resting position to the pulled position.

Example 3 includes the subject matter of Example 2, wherein the trigger includes a trigger body defining a trigger axis of rotation and a first lever portion extending upward from the trigger body to a distal end portion, the distal end portion of the first lever portion engaging the control arm of the second sear when the trigger moves from the resting position to the pulled position.

Example 4 includes the subject matter of Example 3, wherein the distal end portion of the first lever portion includes a roller.

Example 5 includes the subject matter of Example 4, wherein the distal end portion defines a channel and the roller is mounted in the channel.

Example 6 includes the subject matter of Example 4 or 5, wherein the control arm defines a slot sized and configured to engage the roller when the trigger moves between the resting position and the pulled position.

Example 7 includes the subject matter of any of Examples 1-6, wherein the trigger is configured as a two-stage trigger, and wherein the second sear moves from the blocking position to the non-blocking position during a first stage of trigger travel from the resting position to the pulled position.

Example 8 includes the subject matter of Example 7, wherein the first stage of trigger pull has a tensile extension 0.05 to 0.2 inches.

Example 9 includes the subject matter of any of Examples 1-8 and further comprises a trigger bar between the trigger and the first sear, the trigger bar operable between a first position and a second position, the trigger bar having a first end portion, a second end portion, and an axis of rotation between the first end portion and the second end portion, wherein the second end portion engages a part of the trigger, and wherein the first end portion defines a catch surface positioned to engage the first sear when the trigger bar is in the first position and the first sear is in the cocked position.

Example 10 includes the subject matter of Example 9, and further comprises a trigger bar spring that biases the trigger bar to the first position.

Example 11 includes the subject matter of any of Examples 9 or 10, wherein the trigger bar has a trigger bar axis of rotation that is substantially coincident with a center of gravity of the trigger bar.

Example 12 includes the subject matter of any of Examples 1-11, wherein the trigger has a trigger axis of rotation that is substantially coincident with a center of gravity of the trigger.

Example 13 includes the subject matter of any of Examples 1-12 and further comprises a trigger housing, wherein each of the trigger, the first sear, and the second sear is rotatably attached to the trigger housing; a trigger weight lever rotatably attached to the trigger housing, the trigger weight lever having an arm engaging the trigger to bias the trigger to the resting position; a threaded fastener retained by the trigger housing; a spring catch movable in response to rotation of the threaded fastener; and a trigger spring with a first spring end and a second spring end, the first spring end connected to the trigger weight lever and the second spring end connected to the spring catch; wherein rotating the threaded fastener changes a trigger weight of the trigger.

Example 14 includes the subject matter of Example 13 and further comprises a catch body on the spring catch, the catch body threadably engaging the threaded fastener such that rotating the threaded fastener changes a position of the spring catch.

Example 15 includes the subject matter of Example 13 and further comprises a catch body on the spring catch, the catch body connected to the threaded fastener, wherein the position of the spring catch changes in response to advancing or retracting the threaded fastener with respect to the trigger housing.

Example 16 includes the subject matter of any of Examples 13-15, wherein the arm of the trigger weight lever is a first arm extending in a first direction and the trigger weight lever further comprises a second arm extending in a second direction different from the first direction and the first end of the spring is connected to the second arm of the trigger weight lever.

Example 17 is a trigger assembly comprising a trigger housing; a trigger attached to the trigger housing and operable between a resting position and a pulled position, the trigger having a trigger body defining a trigger axis of rotation, a finger portion extending downward from the trigger body, and a lever portion extending from the trigger body; a trigger weight lever pivotably attached to the trigger housing, the trigger weight lever having an arm engaging the lever portion of the trigger; a threaded fastener retained in the trigger housing; and a spring catch movable in response to rotation of the threaded fastener; and a trigger spring having a first end connected to the trigger weight lever and a second end connected to the spring catch; wherein rotating the threaded fastener moves the spring catch to change a trigger weight of the trigger.

Example 18 includes the subject matter of Example 17, wherein the arm is a first arm extending in a first direction, and the trigger weight lever further comprising a second arm extending in a second direction different from the first direction, wherein the first end of the trigger spring is connected to the second arm of the trigger weight lever.

Example 19 includes the subject matter of any of Examples 17 or 18, wherein the spring catch threadably engages the threaded fastener such that rotating the threaded fastener changes a position of the spring catch.

Example 20 includes the subject matter of any of Examples 17 or 18, wherein the spring catch is connected to an end of the threaded fastener, wherein a position of the spring catch changes in response to advancing or retracting the threaded fastener with respect to the trigger housing.

Example 21 includes the subject matter of any of Examples 17-20, wherein the trigger housing includes a trigger guard around the finger portion of the trigger, the trigger guard defining an opening that is coaxially aligned with the threaded fastener.

Example 22 includes the subject matter of any of Examples 13-21, wherein the trigger housing is configured for removable installation in a rifle receiver.

Example 23 is a firearm comprising the trigger assembly of any of Examples 1-22.

Example 24 includes the subject matter of Example 23, wherein the firearm is a bolt-action rifle.

Example 24 includes the subject matter of Example 23, wherein the firearm is a semi-automatic handgun.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A trigger assembly for a firearm having a striker movable along a bore axis between a cocked position and a fire position, the trigger assembly comprising:

a trigger operable between a resting position and a pulled position, a first sear operably coupled to the trigger and the striker, wherein when the striker is in the cocked position the first sear is movable from an engaged position to a disengaged position in response to moving the trigger from the resting position to the pulled position; and a second sear positioned forward of the first sear, the second sear operably coupled to the trigger and movable from a blocking position to a non-blocking position in response to moving the trigger from the resting position to the pulled position, wherein when the trigger is in the resting position the second sear has a blocking portion positioned to halt forward motion of the striker from the cocked position to the fire position.

2. The trigger assembly of claim 1, wherein the second sear includes a control arm, the control arm engaging a part of the trigger when the trigger moves from the resting position to the pulled position.

3. The trigger assembly of claim 2, wherein the trigger includes a trigger body defining a trigger axis of rotation and a first lever portion extending upward from the trigger body to a distal end portion, the distal end portion of the first lever portion engaging the control arm of the second sear when the trigger moves from the resting position to the pulled position.

4. The trigger assembly of claim 3, wherein the distal end portion of the first lever portion includes a roller.

5. The trigger assembly of claim 4, wherein the distal end portion of the first lever portion defines a channel and the roller is mounted in the channel.

6. The trigger assembly of claim 4, wherein the control arm defines a slot sized and configured to engage the roller when the trigger moves between the resting position and the pulled position.

7. The trigger assembly of claim 1, wherein the trigger is configured as a two-stage trigger, and wherein the second sear moves from the blocking position to the non-blocking position during a first stage of trigger travel from the resting position to the pulled position.

8. The trigger assembly of claim 7 further comprising a trigger bar between the trigger and the first sear, the trigger bar operable between a first position and a second position, the trigger bar having a first end portion, a second end portion, and an axis of rotation between the first end portion and the second end portion, wherein the second end portion engages a part of the trigger, and wherein the first end portion defines a catch surface positioned to engage the first sear when the trigger bar is in the first position and the first sear is in the cocked position.

9. The trigger assembly of claim 8, wherein the trigger bar has a trigger bar axis of rotation that is substantially coincident with a center of gravity of the trigger bar.

10. The trigger assembly of claim 1, wherein the trigger has a trigger axis of rotation that is substantially coincident with a center of gravity of the trigger.

11. The trigger assembly of claim 1 further comprising:

a trigger housing, wherein each of the trigger, the first sear, and the second sear is rotatably attached to the trigger housing;

a trigger weight lever rotatably attached to the trigger housing, the trigger weight lever having an arm engaging the trigger to bias the trigger to the resting position;

a threaded fastener retained by the trigger housing;

a spring catch movable in response to rotation of the threaded fastener; and a trigger spring with a first spring end and a second spring end, the first spring end connected to the trigger weight lever and the second spring end connected to the spring catch;

wherein rotating the threaded fastener changes a force necessary to move the trigger from the resting position to the pulled position.

12. The trigger assembly of claim 11, further comprising:

a catch body on the spring catch, the catch body threadably engaging the threaded fastener such that rotating the threaded fastener changes a position of the spring catch.

13. The trigger assembly of claim 11, further comprising:

a catch body on the spring catch, the catch body connected to the threaded fastener, wherein the position of the spring catch changes in response to advancing or retracting the threaded fastener with respect to the trigger housing.

14. The trigger assembly of claim 11, wherein the arm is a first arm extending in a first direction and the trigger weight lever further comprises a second arm extending in a second direction different from the first direction and the first end of the spring is connected to the second arm of the trigger weight lever.

15. A firearm comprising the trigger assembly of claim 1.

16. The firearm of claim 1, wherein the firearm is a bolt-action rifle.

* * * * *